United States Patent [19]

Kuchenbecker

[11] 4,270,659

[45] Jun. 2, 1981

[54] RECLOSABLE DISPENSING BLISTER CARD PACKAGE

[75] Inventor: Morris W. Kuchenbecker, Neenah, Wis.

[73] Assignee: American Can Company, Greenwich, Conn.

[21] Appl. No.: 103,849

[22] Filed: Dec. 14, 1979

[51] Int. Cl.[3] ..... B65D 83/04; B65D 85/56

[52] U.S. Cl. ..... 206/538; 206/539; 206/470

[58] Field of Search ..... 206/538, 539, 531, 532, 206/470

[56] References Cited

U.S. PATENT DOCUMENTS

| | | | |
|---|---|---|---|
| 2,899,046 | 8/1959 | Cox, Jr. | 206/538 |
| 2,971,638 | 2/1961 | Allison et al. | 206/539 |
| 3,025,952 | 3/1962 | Phipps | 206/533 |
| 3,303,927 | 2/1967 | Ballard | 206/539 |
| 4,169,531 | 10/1979 | Wood | 206/539 |

*Primary Examiner*—William T. Dixson, Jr.

*Attorney, Agent, or Firm*—Robert P. Auber; Thomas D. Wilhelm

[57] ABSTRACT

A reclosable blister card package is provided, having an insert which rotates inside the blister cavity to present product-holding compartments to the dispensing opening. The insert and blister are cooperatively sized and configured for smooth and efficient rotation of the insert within the blister cavity. Opening features provide the dispensing opening, and reclosure features provide for continuing containment and protection of the unused portion of the product.

12 Claims, 4 Drawing Figures

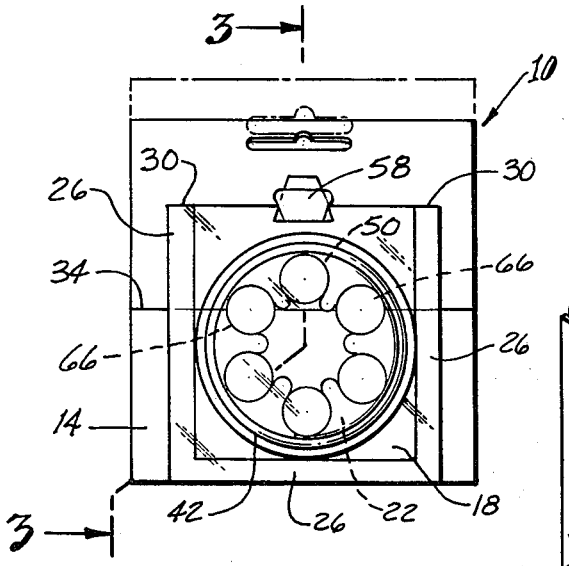
FIG.1
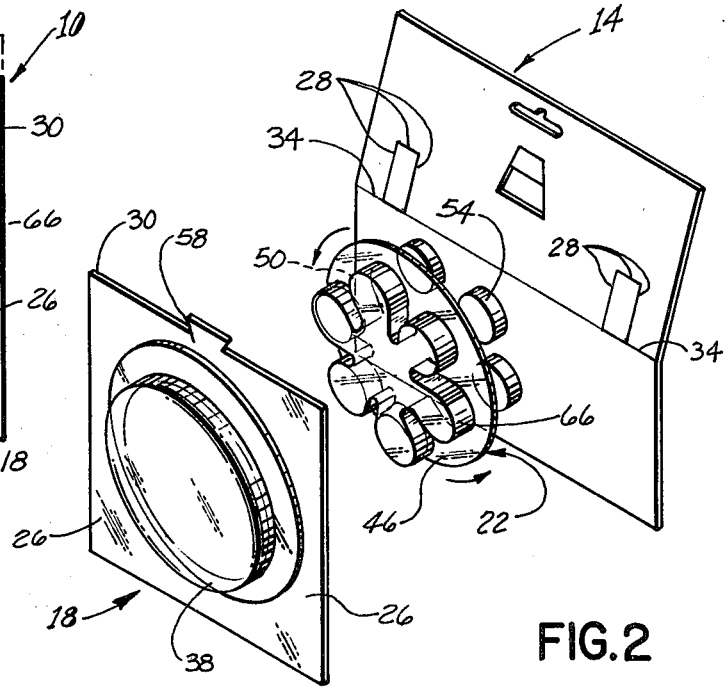
FIG.2
FIG.3
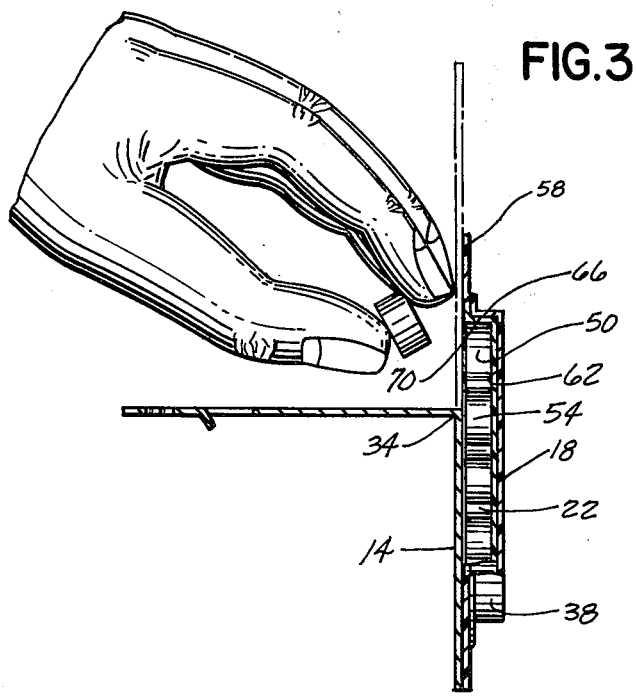
FIG.4
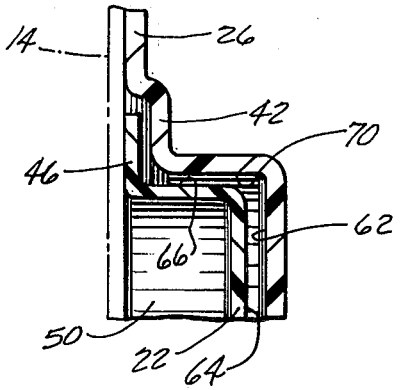

RECLOSABLE DISPENSING BLISTER CARD PACKAGE

BACKGROUND OF THE INVENTION

Blister packages are beneficial to the merchandizer in that they provide good product visibility, and therefore attract customer attention to the contained product, in addition to providing bulk to the package, thus discouraging theft. Compared to other forms of packaging providing good product visibility, blister packaging is attractively economical. It is believed that initially all blister packages had complete and uniform adhesion around the flange between the blister and the backing board. Normally, the adhesion is very strong, and these packages are thus limited to a one-time use, because either the board or the blister is destroyed when the package is opened. In many cases, though, blister packages could be advantageously used if the package could be opened with minimal package damage, and subsequently reclosed to contain the unused portion of the product. This is particularly advantageous where portions of the contained product are normally removed periodically for use—and the unused portion of the product requires the continuing protection and containment provided by the package.

This invention relates specifically to reclosable blister packages. Reclosable blister packages have been developed which, by various means, allow the package to be opened without substantial package damage, and which provide some reclosing feature. These developments are described in U.S. Pat. Nos. 3,127,010; 3,174,621; 3,502,486; 4,119,203; and 4,166,535. A recent development is described in United States patent application Ser. No. 958,716, filed Nov. 8, 1978, which has now been indicated as allowable.

In the known art of blister packages having a multiplicity of compartments, gaining access to the product in any given compartment requires penetrating the package at the appropriate compartment, normally by tearing. When a number of compartments are involved in the package, the appearance of the torn package may rapidly deteriorate as additional compartments are torn open. There is also the very real risk of inadvertently opening more than one compartment, or the wrong compartment. Thus it would be desirable to provide a reclosable blister package having a multiplicity of product-holding compartments to which access may be gained, separately and individually, through a single opening, and without reducing the capacity of the package to contain product. It would also be desirable if product could be removed from, and subsequently replaced into, individual compartments.

It is therefore an object of this invention to provide a reclosable blister package having a blister cavity which contains multiple product-holding compartments, each compartment being capable of being separately presented to a dispensing opening in the package.

It is a further object to provide such a package having a blister with a product-holding cavity, and a rotatable insert in the cavity, the insert having a multiplicity of product-holding compartments.

It is a more specific object to provide a reclosable blister package having a rotatable insert capable of holding products in a multiplicity of product-holding compartments, inside the blister cavity, and a means for opening the package and presenting the compartments to the opening; and in doing so in such a manner that product may be removed from a given compartment, and subsequently replaced into the same, or a similar compartment; the removal and replacement proceeding without substantially damaging the compartment or the overall package, or reducing its product-holding capacity.

SUMMARY OF THE INVENTION

It has now been found that certain of the foregoing and related objects are obtained in a reclosable blister card package having an opening end defined thereon, and composed of a backing board, a blister member secured to one surface of the backing board by means of a substantially peripheral blister flange, and an insert. The blister has a cavity therein, the board and blister being so cooperatively arranged and configured that the board may be rotated away from the cavity to expose the cavity. The insert is disposed in the blister cavity and is generally circular, having an array of pockets for containing products, the cavity and the insert being adapted and configured such that the insert is rotatable within the cavity.

In one embodiment wherein a limited portion of the cavity is exposed upon opening, the board has a hinge line extending in a direction transverse to the opening end and providing means for rotation of the opening end of the board away from the cavity. The board also has, on its opening end, cutscores, in the surface facing the blister, substantially in register with the blister flange and the adhesive securing the flange to the backing board, and extending to the hinge line. The cutscores provide controlled delamination of the card upon opening of the package. The card and the blister have cooperative means such as a tab and slot for reclosure of the package.

For typical applications of the blister package, it is desirable that both the cavity and the insert be substantially circular, the inner sidewalls of the cavity and the outer sidewalls of the insert being in substantially abutting relationship. In certain embodiments, such as those having the above abutting relationship, the insert is rotatable about a substantially fixed axis. In certain embodiments the pockets are arranged about the periphery of the insert, and the package, when opened, is adapted for sequentially presenting individual pockets for removal of product. For convenience of design and package operation, the board hinge line may be positioned between the opening end of the blister and a point halfway between the opening end and the closed end of the blister.

BRIEF DESCRIPTION OF THE DRAWINGS

FIG. 1 is a plan view of a blister package of this invention, showing the package partially opened.

FIG. 2 is an exploded view of the package with the individual components, and sample products, shown in proper alignment for assembly into a closed package.

FIG. 3 is a partially cut away side view of the package taken at line 3—3 of FIG. 1, showing the package fully opened, and product being removed.

FIG. 4 is an enlarged view of a portion of the package shown in FIG. 3, showing the relationships between the board, the cavity, and the insert in the area of the insert flange.

DETAILED DESCRIPTION OF THE PREFERRED EMBODIMENTS

The blister package generally designated 10 is composed of a paperboard backing board 14, a blister 18, and an insert 22. Board 14 has a pair of U-shaped cutscores 28 in the surface facing blister 18 wherein the top edge 30 of the blister flange is adhered to the board. Cutscores 28 extend downwardly in the board 14 from the mating top edge 30 of the blister to score line 34 which extends across board 14 in a direction transverse to the package opening end, from the right side edge of the board, as seen in FIG. 2, to the left side edge.

Blister 18 has incorporated thereinto a cavity 38 generally surrounded by peripheral flange 26, and suitable for holding product. Cavity 38 has a stepped ring 42 around its periphery at the intersection of cavity 38 and flange 26. Ring 42 is recessed a short distance from the face of flange 26. For example, in a typical blister, ring 42 is recessed about 1.5 millimeters. Insert 22 has a peripheral ring 46, lying generally in the plane of the insert surface confronting board 14 and extending outwardly beyond the product-holding compartments. Ring 46 conforms with, and fits inside, ring 42 on the blister, as shown in FIG. 4. Compartments 50 are arrayed about the outside edge of the insert and are configured for holding product 54, such as hearing aid batteries. Generally, it is convenient for each compartment to be designed to hold the amount of product which is expected to be dispensed at one time.

In assembling the blister package from the components (board, insert, and blister)—the insert is placed inside the blister cavity such that the product-holding compartments are disposed inside the cavity, with their product receiving openings disposed respectively away from the cavity. Ring 46 on the insert is seated inside the recess formed by ring 42 on the blister. The board is then brought into confronting relationship with the blister, and sealed to the blister at the bottom and right and left sides of flange 26, by means of an adhesive, not shown. Acceptable adhesives are well known in the blister packaging art. In a typical application, the paperboard card is coated with a heat sealable material, such as low density polyethylene. The card is sealed to the blister by bringing the blister and board surfaces together and applying sufficient heat to the interface to soften the polyethylene and effect the adhesion and sealing. Product 54 may be inserted into the product-holding compartments 50 of insert 22 at any time up to the time of sealing board 14 to blister 18.

In opening and using the blister package, the backing board 14 is pulled away from the blister at tab 58 and rotated about hinge line 34, making an opening in the package through which product may be dispensed. In so doing, the paperboard inside cutscores 28 is delaminated by ply separation providing controlled opening in a known manner. At that time the opened package is configured generally as shown in FIG. 3. The only tearing of the package necessary in opening it is the delamination of the paperboard inside cutscores 28. As this tearing is fully controlled, the ability of the package to contain and protect the product remains intact; and product may be removed or replaced through the opening at will. Insert 22 is rotated inside cavity 38, if necessary, to present a product-holding compartment to the opening for dispensing a unit of product. Additional compartments may be presented to the opening by rotating insert 22, making the additional units of product in those compartments available to the user. Thus the user may inspect the products in each compartment, and may select those products desired by rotating the insert and bringing each compartment to the dispensing opening, without substantial damage to either package or product. Thus all of the product may be removed and/or replaced through the single dispensing opening by rotating the appropriate product-holding compartments sequentially to the opening. The package is reclosed by rotating the board about hinge 34 and locking tab 58 behind the board in known manner.

It is important that insert 22 fit freely into cavity 38, and that it fit freely between blister 18 and board 14. Further, insert 22 is free of any affixation to either board 14 or blister 18; except that insert 22 may be affixed to either the board or the blister at its axis of rotation. In order to assure that insert 22 rotates freely and efficiently inside cavity 38, the thickness dimension of the insert must be less than the distance in the assembled package between the surface of the board and the inside surface 62 of the cavity, thus assuring adequate clearance between surface 62 of the cavity and the insert. A further limitation on the finished package of the embodiment illustrated in the drawings is that ring 46 on the insert must fit freely within the annular space formed between the inside of ring 42 on the cavity and the facing surface of the board 14. Thus, dimensionally, the thickness of ring 46 on the insert must be less than the distance, in the assembled package, between the board surface and the inside of blister ring 42. In the typical structure, then, of the embodiment shown, the positioning of insert 22 is substantially controlled by rings 42 and 46, by their cooperation with each other and with the backing board 14; and by the cooperative interfacing sidewall surfaces 66 and 70 on the insert and the cavity respectively. Thus there is normally minimal, if any, contact between inside bottom surface 62 of the cavity and surface 64 of the insert. While insert 22 is shown substantially filling cavity 38, for purposes of standardization it may be desirable to have a space between insert 22 and the inner surface 62 of the cavity. Such an arrangement is entirely satisfactory, and is within the scope of the invention.

In some embodiments ring 46 may be deleted. In these embodiments, the positioning of insert 22 relative to the blister and board is controlled by the dimensional clearances between the surfaces 62 and 70 of the cavity, the corresponding facing surfaces 64 and 66 of the insert, and the facing surfaces of the paperboard and the insert. Thus when the insert is rotated, it rubs against the appropriate surface, or surfaces, which effectively resist substantial lateral movement of the insert.

In order to provide controlled rotation of the insert about a generally fixed axis, it is preferable that the outer edges 66 of the raised portions of the insert abut loosely against the inside facing surface 70 of the blister cavity. In the embodiment shown, edges 66 are located on the outer edges of product-holding compartments 50.

Insert 22 may take a variety of shapes for holding products having specific dimensions. Likewise cavity 38 need not be particularly circular so long as it serves to confine and control the rotation of insert 22. For example, in an embodiment not shown, cavity 38 may be square with the transverse distance across the short dimension of the square conforming to the insert and confining it generally to rotational movement. In this embodiment, it may be desirable to provide a raised collar around insert 22 at the inside edge of ring 42 to mate continuously with the inside facing surface 70 of the blister.

Thus it can be seen that this invention provides a reclosable blister package having a blister cavity which contains multiple product-holding compartments, each compartment being capable of being separately presented to a dispensing opening in the package.

It further provides such a package having a blister with a product-holding cavity, and a rotatable insert in the cavity, the insert having a multiplicity of product-holding compartments.

Specifically, it provides a reclosable blister package having a rotatable insert capable of holding products in a multiplicity of product-holding compartments inside the blister cavity, and a means for opening the package and presenting the compartments to the opening; and in doing so in such a manner that product may be removed from a given compartment, and subsequently replaced into the same, or a similar compartment without substantially damaging the package or reducing its product-holding capacity.

Having thus described the invention, what is claimed is:

1. A reclosable blister package having an opening end defined thereon comprising: a backing board; a blister; and an insert; said blister being secured to one surface of said backing board by means of a substantially peripheral blister flange, said blister having a cavity therein; said board and said blister being so cooperatively arranged and configured that said board may be rotated away from said cavity to expose said cavity; said insert being generally circular and having an array of pockets for containing products, said cavity and said insert being adapted and configured such that said insert is rotatable within said cavity.

2. A reclosable blister package as in claim 1, said board and said blister each having an opening end defined thereon and conforming to the opening end of said package.

3. A reclosable blister package as in claim 2 wherein a limited portion of said cavity is exposed upon opening the package, said board having a hinge line extending in a direction transverse to said package opening end and providing means for rotation of said board away from said cavity, said board also having, on its opening end, cutscores in said one surface substantially in register with said blister flange and extending to said hinge line; said cutscores providing controlled delamination of said board upon opening of the package; said board and said blister having cooperative means for reclosure of said package.

4. A reclosable blister package as in claim 1, 2, or 3 the inner sidewall of said cavity being in substantially abutting relationship with at least a portion of the outer sidewall of said insert.

5. A reclosable blister package as in claim 1, 2, or 3 where said insert is rotatable about a substantially fixed axis.

6. A reclosable blister package as in claim 4 wherein said pockets are arranged about the periphery of said insert, and wherein said package, when opened, is adapted for presenting an individual pocket for removal of product therefrom.

7. A reclosable blister package as in claim 5 wherein said pockets are arranged about the periphery of said insert, and wherein said package, when opened, is adapted for presenting an individual pocket for removal of product therefrom.

8. A reclosable blister package as in claim 3 wherein said hinge line is positioned between the opening end of said blister and a point halfway between the opening end of said blister and the closed end of said blister.

9. A reclosable blister package as in claim 4 wherein both said cavity and said insert are substantially circular.

10. A reclosable blister package as in claim 1 or 2 said cavity having a stepped ring around the periphery thereof at the intersection of said cavity and said flange, the surface of said ring being recessed from the face of said flange, and providing a space between said stepped ring and said backing board upon assembly; said insert having a peripheral ring around its outside edge thereof, said peripheral ring being located on the surface of said insert confronting the board in the closed package, and being disposed in said space between said backing board and said stepped ring.

11. A reclosable blister package as in claim 10 wherein said stepped ring, said peripheral ring, the inner sidewalls of said cavity, the outer sidewalls of said insert, and said board cooperate with each other to substantially control the positioning of said insert within said cavity.

12. A reclosable blister package, as in claim 11, said package having a space between said insert and the inside bottom surface of said cavity.

* * * * *